US006202604B1

(12) United States Patent
Silvers

(10) Patent No.: US 6,202,604 B1
(45) Date of Patent: Mar. 20, 2001

(54) MAXIMUM COMPRESSION SPARK PLUG

(76) Inventor: Craig D. Silvers, P.O. Box 856, Camdenton, MO (US) 65020

( * ) Notice: Subject to any disclaimer, the term of this patent is extended or adjusted under 35 U.S.C. 154(b) by 0 days.

(21) Appl. No.: 09/480,582

(22) Filed: Jan. 10, 2000

(51) Int. Cl.[7] ..... F02D 15/04; F02P 13/00
(52) U.S. Cl. ..... 123/48 R; 123/169 EC; 313/118
(58) Field of Search ..... 123/48 R, 78 R, 123/169 R, 169 EC; 313/118, 125

(56) References Cited

U.S. PATENT DOCUMENTS 5,388,561 * 2/1995 Cullum et al. ..... 123/169 EC X

FOREIGN PATENT DOCUMENTS

2619856 * 3/1989 (FR) ..... 123/48 R
3-258930 * 11/1991 (JP) ..... 123/48 R

* cited by examiner

*Primary Examiner*—Tony M. Argenbright

(74) *Attorney, Agent, or Firm*—Richard J. Grunstrom

(57) ABSTRACT

The present invention is designed to increase performance of most internal combustion engines by raising the compression in the combustion dome without having to go through the common process of removing engine parts and machining off material at the gasket surface of the cylinder head. This is done by the spark plug obtaining volume in said dome by extending the spark plug's threaded section deep into the chamber area without contacting the piston. Most sparks plugs could be extended from ¼" to 1" deeper before interfering with the piston.

Adjustable locking nuts on the threaded portion of the spark plug would allow the user to adjust the amount of compression increase and eliminate the need to manufacture a separate spark plug for each different engine application. Currently three different thread diameters are mainly used in spark plug manufacturing, 14 mm, 12 mm, and 10 mm.

Since the displacement of the protruding spark plug will normally be 2 cc's of volume or less, smaller engines will notice a larger increase in compression. These engines will include motorcycles, ATV's, personal watercraft, outboard marine engines, lawn mowers, go-carts, and many other applications.

5 Claims, 2 Drawing Sheets

MAXIMUM COMPRESSION SPARK PLUG

BACKGROUND OF THE INVENTION

1. Field of the Invention

This invention relates to spark plugs and the means to increase compression in the combustion area of an internal combustion engine by extending the threaded section to protrude deep into the combustion dome.

2. Description of the Prior Art

Most spark plugs are designed to increase usage time by using special materials to keep said spark plug from fouling or wearing out. Some spark plugs are designed with different electrode tip formations to increase combustion efficiency.

The present invention is designed to increase the combustion pressure of most internal combustion engines. Extending the spark plug's threaded section into the combustion area or dome, less volume remains for said combustion area. With less volume in the combustion area the piston now squeezes the fuel vapors into a tighter space. This higher compression will yield an increase of power output in most gasoline engines.

The present invention distinguishes itself from any previous spark plugs by the extended threaded section and double nuts to lock in the preferred depth.

SUMMARY OF THE INVENTION

The present invention is an original design for a spark plug to be used as a 'compression increasing' object. Said spark plug has a longer threaded section than any other spark plug, which is threaded deeper into the combustion chamber or dome.

DETAILED DESCRIPTION

Figure 1:
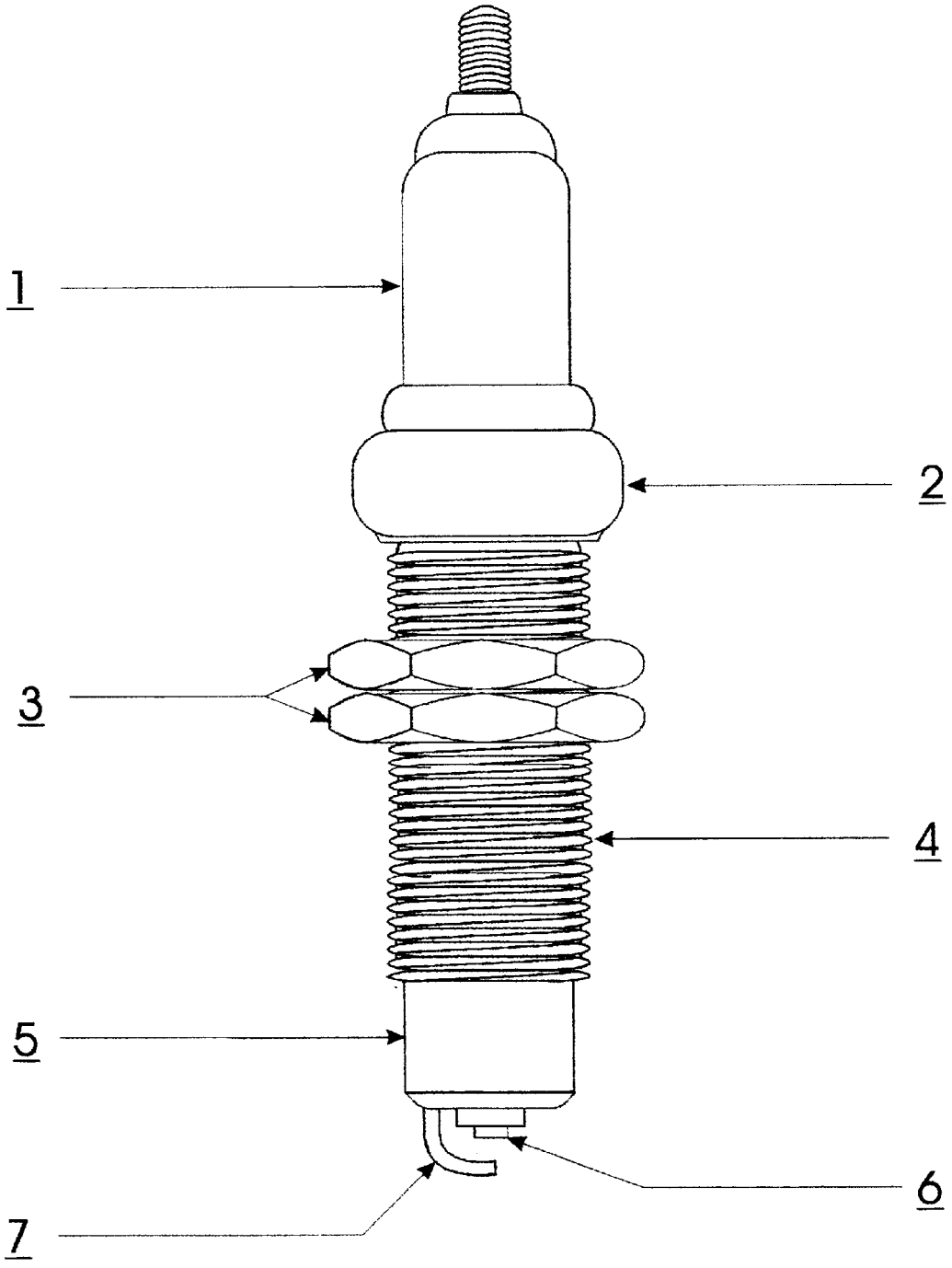
FIG. 1 shows a side view of one embodiment of the maximum compression spark plug of this invention.

FIG. 1 shows the basic layout of a compression increasing spark plug. Some of the parts are familiar in design such as, the insulator 1, the body or shell 2, the extended nose 5, the electrode 6, and the electrode tip 7. The style, size, or the material of the above said parts is not relative to the present invention.

The extended threaded section 4 and the locking nuts 3 are the parts that are unique to the present invention.

Figure 2:
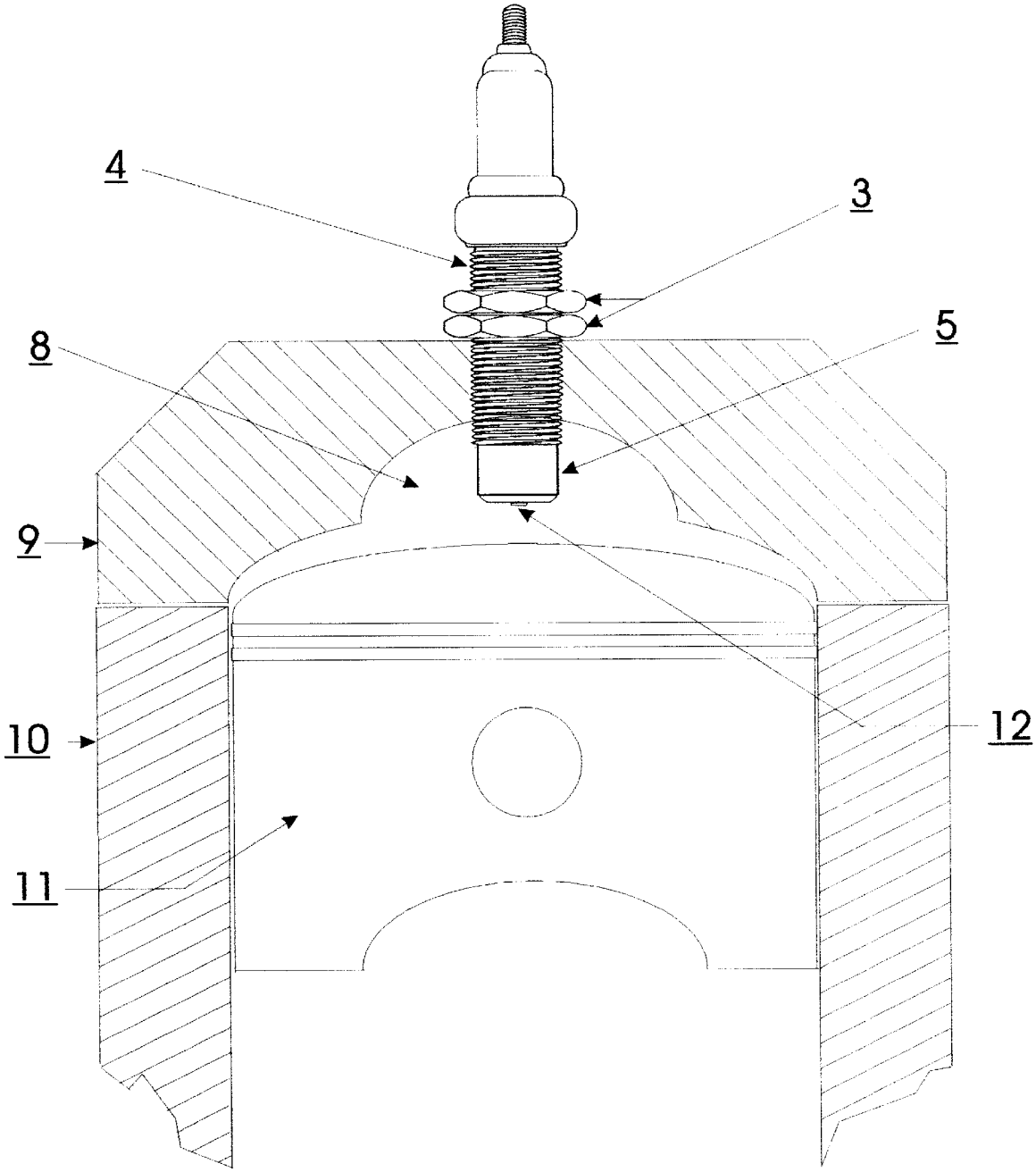
FIG. 2 shows a side view of another embodiment consisting of a surface gap maximum compression spark plug installed in a typical head of an engine.

FIG. 2 shows a compression increasing spark plug installed in a basic internal combustion engine. The cylinder head 9, cylinder 10, and piston 11 represent the relationship of the location and placement to understand the means in which the present invention raises compression.

A pair of locking nuts 3 will be tightened against each other to lock on the extended threaded section 4. The locking nuts 3 also allows the user to adjust the amount of compression gained by varying the height of said locking nuts 3 which determines how deep the extended threaded section 4, the extended nose 5, and any electrode 6 extends into the combustion chamber 8 which lowers the volume of said area and makes the compression raise in the combustion chamber 8.

The surface gap electrode 12 would be a better choice due to its solid end, which allows for even higher compression than the hollowed end electrode tip 7 type spark plug.

The threaded section of a spark plug that inserted in to a cylinder head is extended to obtain space that will raise the compression of said combustion area. Generally, this spark plug should be designed to fill as much space as possible. This said protrusion would normally be cylindrical in shape and may contain any electrode tip and material combination including the surface gap type spark plug that would be preferred.

What is claimed is:

1. A compression increasing spark plug comprising:

an elongated insulator;

an elongated electrode extending longitudinally through a center of said insulator with ends of said elongated electrode being exposed at a lower end and an upper end of said insulator;

a body surrounding a lower portion of said insulator, said body having an extended threaded section about said body; an extended nose at a lower end of said extended threaded section; and a second electrode at an end of said extended nose, said lower end of said insulator and a lower end of said elongated electrode being exposed at a lower end opening in said extended nose, such that an electric spark can jump or short across a gap between said lower end of said elongated electrode and said second electrode; and a pair of locking nuts on said extended threaded section, said locking nuts being adjustable on said extended threaded section for determining how deep said extended threaded section and said extended nose extend into a combustion chamber of an engine, and said locking nuts being tightened against each other to lock said locking nuts in a position on said extended threaded section.

2. The maximum compression spark plug as set forth in claim 1 in which said second electrode comprises an electrode tip extending from an end of said extended nose to create a gap between said lower end of said elongated electrode and said second electrode.

3. The maximum compression spark plug as set forth in claim 1 in which said second electrode comprises a solid end around a lower end of said extended nose to create a space or gap between said solid end and said lower end of said elongated electrode.

4. A compression increasing spark plug comprising:

an elongated insulator with a lower end and an upper end;

an elongated electrode extending longitudinally through a center of said insulator with a lower end and an upper end of said elongated electrode extending from said lower end and said upper end of said insulator;

a body surrounding a lower portion of said insulator, said body having an extended threaded section; an extended nose at a lower end of said extended threaded section; and an electrode tip extending from a lower end of said extended nose; and said lower end of said insulator and said lower end of said elongated electrode being exposed at a lower end opening in said extended nose; and a pair of locking nuts on said extended threaded section, said locking nuts being adjustable on said extended threaded section for determining how deep said extended threaded section and said extended nose extend into a combustion chamber of an engine, and said locking nuts being tightened against each other to lock said locking nuts in a position on said extended threaded section.

5. A compression increasing spark plug comprising:

an elongated insulator with a lower end and an upper end;

an elongated electrode extending longitudinally through a center of said insulator with a lower end and an upper end of said elongated electrode extending from said lower end and said upper end of said insulator;

a body surrounding a lower portion of said insulator, said body having an extended threaded section, and an extended nose at a lower end of said extended threaded section; said lower end of said insulator and said lower end of said elongated electrode being exposed at a lower end opening in said extended nose; and a solid end around said lower end opening of said extended nose, such that a spark can jump across a gap between said lower end of said elongated electrode and said solid end; and a pair of locking nuts on said extended threaded section, said locking nuts being adjustable on said extended threaded section for determining how deep said extended threaded section and said extended nose extend into a combustion chamber of an engine, and said locking nuts being tightened against each other to lock said locking nuts in a position on said extended threaded section.

* * * * *